United States Patent [19]

Hakanson

[11] 3,959,826

[45] June 1, 1976

[54] METHOD OF SKEWING TWILL FABRIC TO AVOID LEG TWIST

[75] Inventor: Karin Hakanson, San Francisco, Calif.

[73] Assignee: Levi Strauss & Co., San Francisco, Calif.

[22] Filed: May 15, 1974

[21] Appl. No.: 470,075

[52] U.S. Cl. ..... 2/227; 2/243 R; 26/51.3; 28/72 R

[51] Int. Cl.[2] ..... A41D 1/10

[58] Field of Search ..... 2/227, 243 R, 269, 79, 2/80; 26/51.3, 51.4, 51.5; 28/72 R

[56] References Cited

UNITED STATES PATENTS

| | | | |
|---|---|---|---|
| 34,960 | 4/1862 | Helm | 26/51.3 |
| 848,416 | 3/1907 | Voland et al. | 26/51.3 |
| 1,763,569 | 6/1930 | Van Orman | 26/51.3 |
| 2,928,160 | 3/1960 | Mayer | 26/51.3 X |
| 3,221,689 | 12/1965 | James | 2/227 X |

*Primary Examiner*—H. Hampton Hunter
*Attorney, Agent, or Firm*—Limbach, Limbach & Sutton

[57] ABSTRACT

Leg twist in jeans made of twill fabrics may be avoided by skewing the fabric clockwise or counterclockwise depending on the twill direction before making the garment so that when the garment is laundered the positions of the warp and filling yarns will remain unchanged with respect to each other. For denim an 8% skew based on fabric width introduced in manufacturing the denim gives straight seams throughout the life of the garment.

9 Claims, 4 Drawing Figures

METHOD OF SKEWING TWILL FABRIC TO AVOID LEG TWIST

BACKGROUND OF THE INVENTION

Leg twist is a serious problem in the manufacture of jeans, giving the appearance of a rotation of the legs in the opposite direction of the twill of the fabric after laundering. This invention relates to the avoidance of leg twist caused by unstabilized twill fabrics, usually medium to heavy weight cotton fabrics, used for slacks and jeans. Leg twist is believed to be the result of directional yarn stresses which are inherent in regular twill weave fabrics and thus introduced at the time of fabric construction and enduring until laundering, at which time relaxation of those yarn stresses result in a change of the angular relationship between warp and filling yarns, causing the legs to appear twisted. In certain instances, stresses are introduced into garments by sewing which also gives the leg "twist" appearance, but sewing stresses are outside the scope of this invention, which relates only to leg twist caused by fabric construction. Stabilized twill fabrics, such as permanent press finished, are usually outside the scope of this invention, because the relationship between yarns is chemically fixed. On the other hand, shrinkage stabilization (i.e. Sanforizing) is, of course, included since most cotton twill jeans and slacks are pre-shrunk. The described leg twist does not show on garments at the time of purchase, but only after the garments have been laundered. Leg twist appears after the first laundering and usually grows progressively worse with increased number of launderings. The volume of jeans manufactured from medium to heavy weight cotton twill fabrics, particularly from blue denim, has increased in recent years because of changing apparel buying habits which have created an unprecedented demand for jeans. As a result, the long-standing problem of leg twist, further accentuated by the flared leg bottoms which have been in fashion for several years, has become a substantial problem. It is estimated that the returns of jeans to manufacturers because of leg twist numbers in excess of one hundred thousand annually and that the number of dissatisfied customers who do not return jeans having leg twist exceeds that number by a factor of at least six. Some manufacturers have restored to broken twill weaves in order to avoid the problem of leg twist, but there is a very strong demand for jeans made of regular cotton twill fabrics.

It has been known that fabrics tend to skew during piece dyeing, preparation and finishing. For this purpose, devices such as fabric or weft straighteners have been developed which automatically sense any deviation from the perpendicular relationship between warp and filling yarns and automatically correct such deviation by differential straightening. In this way, registry of prints on fabrics, for example, can be maintained. However, such devices are intended to reduce deviation from the perpendicular state and are not intended to purposefully introduce skew into the fabrics. Commonly, fabric straighteners are used for knit fabrics which are then heat-set to give permanent straightness. Heretofore, any introduction of skew or deviation from the perpendicular relationship between warp and filling yarns in jean weight fabrics has been scrupulously avoided.

SUMMARY OF THE INVENTION

It has traditionally been believed that leg twist was caused by cutting and sewing practices in the garment manufacturer's plant. I have found, however, that leg twist is caused by tensions in the fabrics which are related to the direction of the twill. A right-hand twill twists in the counterclockwise direction and a left-hand twill in the clockwise direction. These tensions may be compensated for by deliberately skewing the fabric in the counterclockwise direction for right-hand twills and in the clockwise direction for a left-hand twill. Thus, the right-hand twills should be skewed by advancing the right selvage with respect to the left selvage (assuming fabric is run face up) which results in counterclockwise skew. Conversely, a left-hand twill cloth should be skewed by advancing the left selvage when run face up. Assuming a right-hand twill run face down to avoid shine in Sanforizing, the left selvage should be advanced. The "face" of a twill fabric is the side normally exposed during the wearing of a garment made from the twill.

The amount of the skew depends upon unknown variables in the manufacture of twill fabrics such as the type of twill weave, the weight of the fabric, the yarn sizes, the twist of the yarns, and possibly other variables. It is believed that the twill angle is the single most important factor. Accordingly, the amount of skew is difficult to quantify precisely, and must be determined empirically for each fabric type. Functionally speaking, the skew should be sufficient so that the angular relationship between the warp and filling yarns remains virtually unchanged upon relaxation during laundering of the fabric. By skewing the fabric having the inherent tension of a twill weave during fabric preparation and finishing the inherent tensions are relaxed and the yarns will maintain this new tensionless relationship upon fabric relaxation during laundering.

I have found that 8% skew of fabric width is optimum for most 100% cotton twill fabrics in the range of 8 to 15 ounces per square yard. For most fabrics commercially used today for the manufacture of blue denim jeans, the skew may be between 4 and 10% of fabric width. In any event, the skew has to be at least 3% to give any compensating skew to counter balance the leg twist problem. If the skew is less than 3% of the width of the fabric, improvment in the problem will result but will not be sufficient to produce a commercially satisfactory garment.

DESCRIPTION OF THE PREFERRED EMBODIMENT

Figure 1:
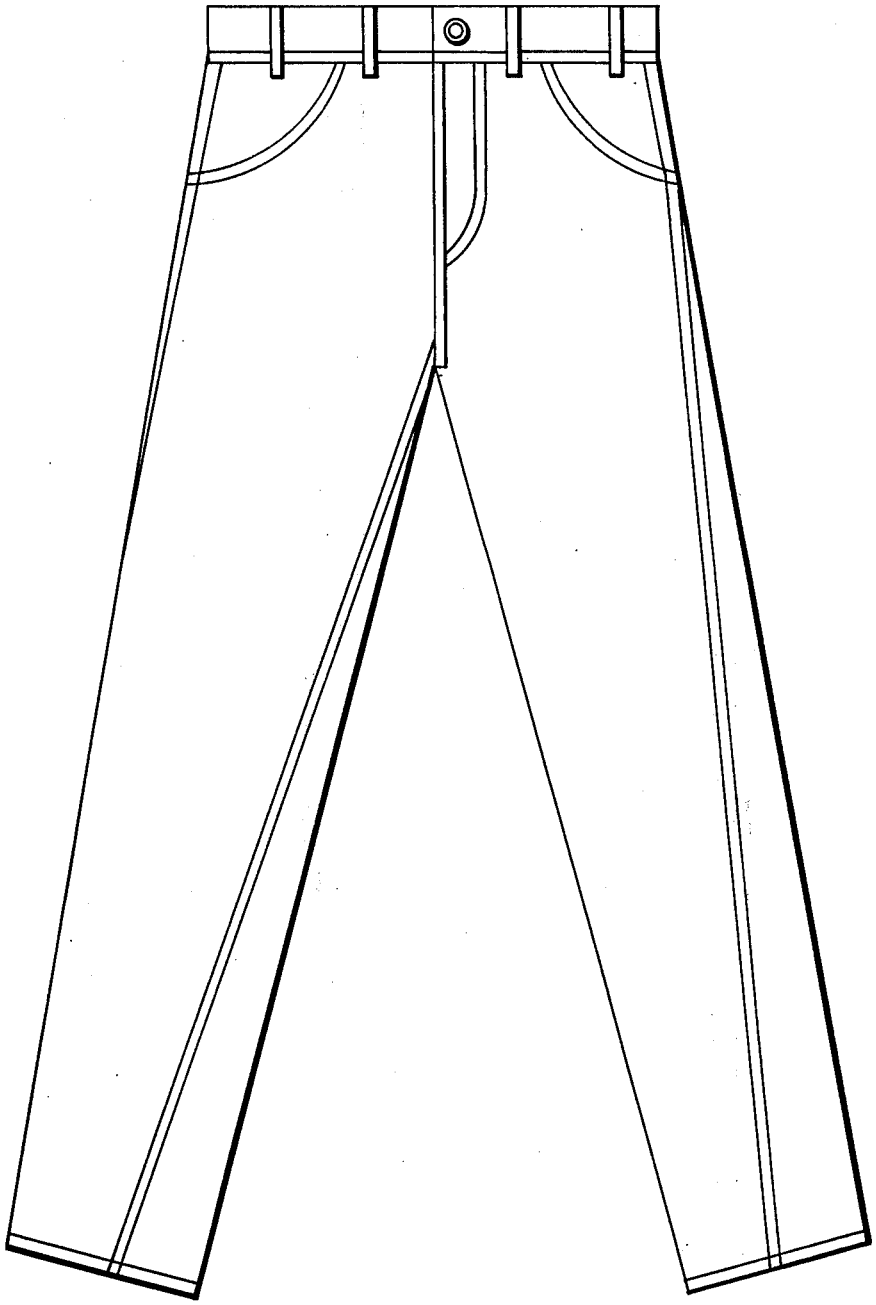
FIG. 1 is a front view of a pair of pants made from right-hand twill fabric exhibiting leg twist according to the prior art.

FIG. 1 is an illustration of a pair of jeans manufactured using prior art methods. Garment 61 has a waistband 62, two front pockets 63 and 64, a fly 66, an inseam 67, shown on the right leg, and an outseam 68, shown on the left leg on FIG. 1. Because of the right hand twill weave used in making the garment in FIG. 1, the legs twist in the manner shown upon washing and drying.

Figure 1:
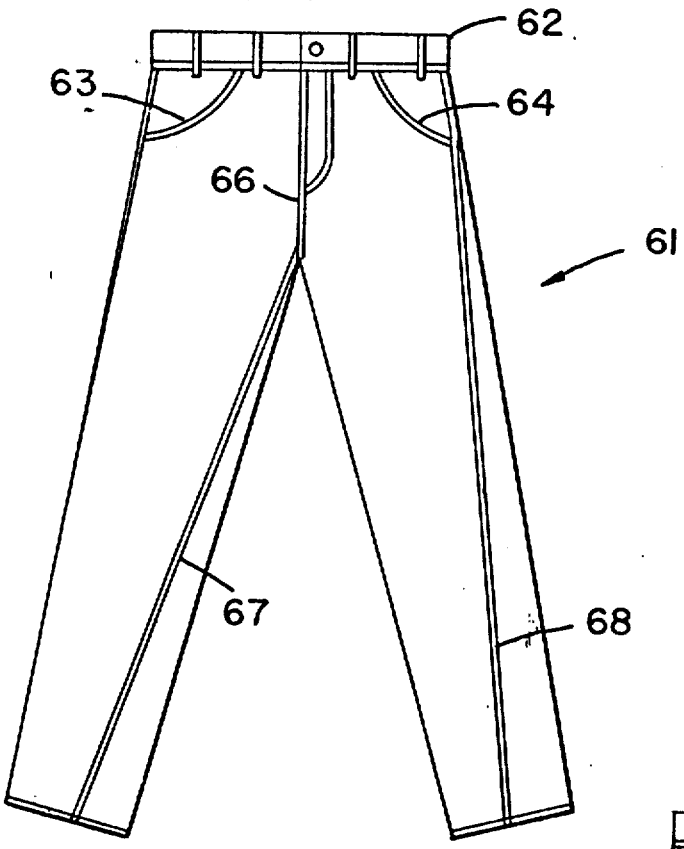
Figure 1A:
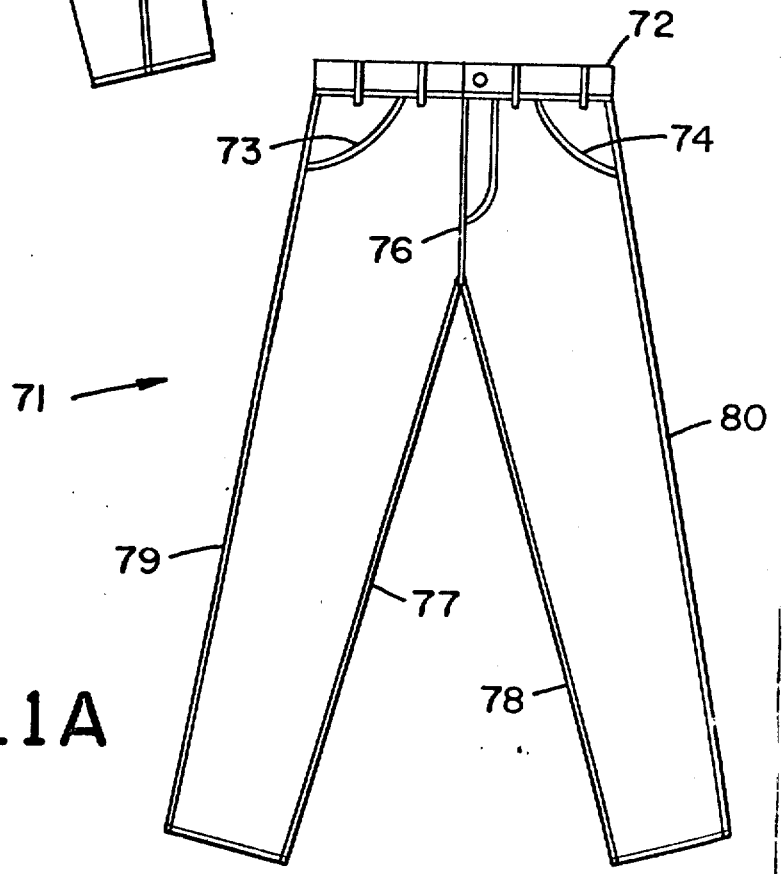
FIG. 1A is a front view of a pair of pants made from right-hand twill fabric according to the present invention.

FIG. 1A illustrates the same kind of garment as in FIG. 1, except made from fabric skewed according to the present invention. FIG. 1A shows a garment 71 with a waistband 72, two front pockets 73 and 74, and a fly 76. Unlike the garment in FIG. 1, that in FIG. 1A has even and straight inseams 77 and 78 as well as outseams 79 and 80. The garment of FIG. 1 has been laundered and graphically illustrates the leg twist caused by approximately 8% filling skew based on fabric width which gives a left-hand leg twist with a right-hand twill. Even though the garment of FIG. 1 was manufactured with the seams running straight down the sides of the legs, upon washing the pants exhibit a twist. By using the present invention, straight seams remain in the garment even after laundering.

The desired skew can be inserted by any suitable means at any stage during fabric preparation and finishing. It is preferred that the skew be inserted while the fabric is in a moist or at least not in a dry state to facilitate skewing of the fabric. It is suggested that in conventional denim finishing, the skew roll device illustrated in FIG. 2, be placed between a pad and subsequent dryer, or, in FIG. 3, between the spray or steam compartment and the tenterette or clip expander of a compressive shrinking range.

Figure 2:
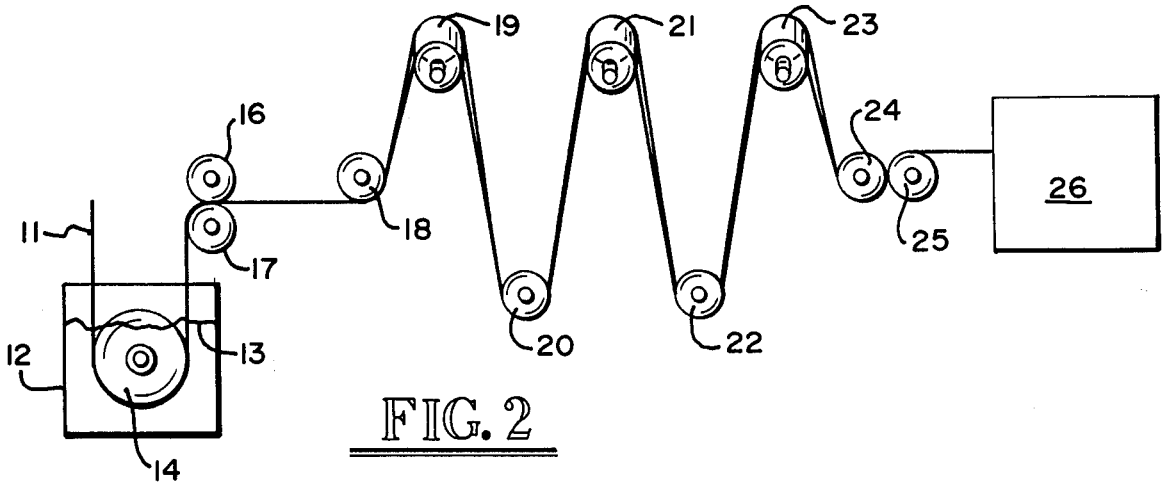
FIG. 2 is a side view of a roller device for carrying out the invention located between a padder and a drier.

FIG. 2 shows an embodiment of a device suitable for carrying out the present invention. In this embodiment rolls are placed at an angle to the idle rolls to decrease the distance traveled by the right edge of the fabric as contrasted to the left edge, so that the left edge is retarded with respect to the right. In FIG. 2, fabric 11 enters a pad bath 12, passing under the level of appropriate liquid 13 by means of pad roller 14 mounted on an appropriate axis. Fabric 11 then passes through squeeze rollers 16 and 17 and then passes roller 18 into the skewing zone.

In the skewing zone, fabric 11 passes three skew rollers 19, 21 and 23 separated by idle rollers 20 and 22. 19, 21 and 23 are skew rolls mounted so that the right hand edge (assuming a right-hand twill fabric run face up) is closer to idle rollers 20 and 22 than is the left edge. Preferably, the pass over each skew roller has a full reversal of direction of approximately 180° to introduce the skew. After passing the three skew rollers 19, 21 and 23 in FIG. 2, the fabric passes a tension compensator between rollers 24 and 25. After the tensioning compensator, fabric 11 then passes into dryer 26.

The relationship between rollers 19 – 23 is greatly exaggerated in FIG. 2 for purposes of illustration. In practice, the skew ordinarily introduced is approximately 8% of the width of the fabric, so that the angular displacement of skew rolls would be much smaller than illustrated.

Most commercially available fabric straighteners have only a single skew roller or a pair of rollers offset the same amount. However, at least two skew rollers, and preferably three or four skew rollers give improved results. A single skew roller has been found insufficient to give a 8% skew in a single pass in heavy weight fabric. Where each skew roller introduces only two or three percent skew of the total 8% skew to be introduced, superior results are obtained.

Figure 3:
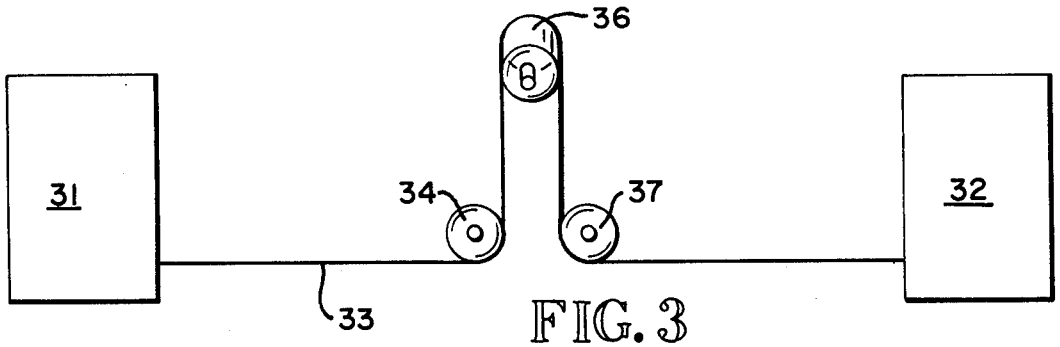
FIG. 3 is a schematic side view of an alternative arrangement of the device of FIG. 2.

FIG. 3 illustrates schematically another embodiment of a device for introducing skew. As with the embodiment shown in FIG. 2, it is assumed that the fabric has a right hand twill, and is run face up so that the skew should be introduced in a counterclockwise direction by either advancing the right edge or retarding the left edge. The term "right hand twill" means that the diagonal of the twill runs from left to right when viewed in the running direction. In this embodiment the skewing zone is placed in a compressive shrinking range, as contrasted to the finishing range of FIG. 2. The compressive finishing range includes a spray compartment 31 for moistening the fabric and a compressive shrinking machine (not shown), and a tenterette 32 shown schematically in FIG. 3. Fabric 33 emerges from steam or spray chamber 31, past idle roller 34 and over skew roller 36. Fabric 33 then passes a second idle roller 37 to tenterette 32 preparatory to compressive shrinking. As with the device of FIG. 2, skew roller 36 is set at an angle so that the left edge of the fabric travels a greater distance than the right, whereby the right edge advances faster than the left to introduce a counterclockwise skew into the fabric.

Figure 4:
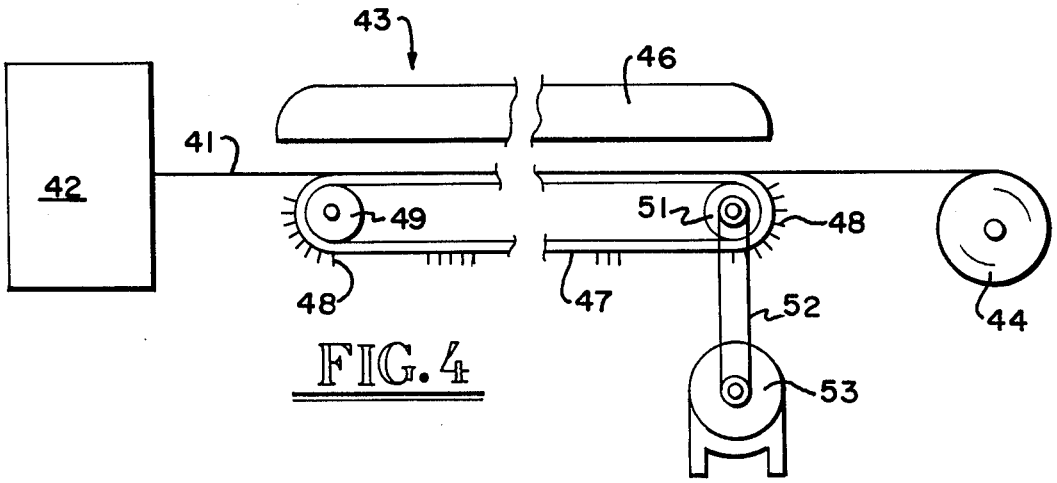
FIG. 4 is a schematic partial side view of a tenter frame suitable for practicing the invention.

FIG. 4 illustrates an alternative device for introducing skew into the fabric comprising a tenter frame. Fabric 41 exits from a bath 42 and enters a tenter frame 43. Bath 42 is any appropriate rewetting step in the fabric finishing process. Bath 42 may be a pad for introducing fabric agents to fabric 41. In some finishing processes, drying cans may be located between bath 42 and frame 43 for pre-drying the fabric, leaving the drying in tenter 43 for width setting. After the tenter frame 43, fabric 41 is rolled up on a take-up roll 44 on a shaft suitably driven. Conventional tenter frames 43 are used for drying fabric in a stretched condition and comprise a hot air drying compartment 46 and fabric gripping means 47. Gripping means 47 retains the fabric stretched in width direction during drying. Gripping means 47 may conveniently be clips which are tripped to close and grasp the fabric as it enters the frame and are tripped to release the fabric at the end of the frame.

An alternative means, shown in FIG. 4, is an endless chain or rail 47 bearing pins 48 extending perpendicularly from the face of chain 47. The pins 48 grasp fabric 41 as the endless chain rotates in clockwise direction around rolls 49 and 51. The pins 48 maintain a fixed relationship between each other on chain 47 and, accordingly, retain the fabric 41 in the same width dimension during drying. Pins 48 automatically release fabric 41 as endless chain 47 passes around roll 51. Roll 51 is driven by means of drive belt 52 driven by motor 53. A corresponding drive means is used for a left-hand endless chain (not shown) on the opposite side of the fabric.

In accordance with the present invention, motor 53 on the right side of the fabric drives endless chain 57 at a rate faster than the corresponding chain on the left side of the fabric. As a result, the right side is advanced and skew is introduced into the fabric.

Any suitable means may be used for introducing skew into the fabric besides the embodiments illustrated in FIGS. 2–4. For example, conical rollers may be used to advance one side faster than the other to introduce skew into the fabric. In operation of any of the devices, the same result occurs: the filling yarns are skewed relative to the warp yarns so that when the inherent distortions in the fabric are relaxed upon laundering, the warp and filling yarns will maintain their relationship. The deliberate introduction of a skew at the time of fabric manufacture serves to prevent the troublesome leg twist that occurs during laundering of garments manufactured from cotton twill fabric.

It is important to maintain the center line speed of the fabric being skewed so that distortions of the fabric are not introduced. It is also important to maintain the skew in the fabric throughout the cutting and sewing operations. No special precautions are needed for maintaining the skew, but care should be taken that forces which would tend to relax the skew of permit "spring back" during subsequent finishing steps are avoided. In practice, such care is normally maintained in Sanforized fabrics because a similar problem with "spring back" exists in the Sanforizing process.

EXAMPLE 1

Indigo blue denim having a width of 45 inches was deliberately skewed during manufacture in accordance with the present invention. A commercial weft straightener manufactured by Coltron Industries, Inc., Charlotte, North Carolina was used between the spray housing and the clip expander of the conventional Sanforizing unit. However, the commercial weft straightener was incapable of introducing the optimum skew of approximately 8%. Only 2.6 inches or 5.8%, based on the 45 inch fabric width, was achieved because of the equipment limitations. The fabric made with such a skew introduced was then used for the manufacture of blue jeans and washed. After a single washing, no skew at all was apparent in the garments, as contrasted to a skew of 6% on a control garment made of the same fabric without skew being introduced. After five washes, the skewed fabric showed a skew of 2.8%, as contrasted to 7.6% for the control garments.

EXAMPLE 2.

In this example, a tenter frame of the type illustrated in FIG. 4 introduces differential advance to the right side of indigo blue denim fabric. The tenter frame has a length of 200 feet and fabric width of 45 inches. The left hand drive chain on the tenter frame is run at 100 yards per minute and the right hand drive chain was run at 100.15 yards per minute to introduce an 8% skew based on the width of the fabric. Garments are then made from the fabrics and washed. After five washings, no leg twist is apparent and no skew in the fabric is measured.

When approximately 8% skew is introduced into conventional heavy weight fabric, the problem of leg twist can be avoided. The present invention provides a simple and effective solution to a long-standing problem in the garment industry which has, in recent years, taken on significant proportions.

I claim:

1. A method of preventing spiral twisting of long seams on denim garments made from twill fabrics comprising the steps of:

deliberately skewing the woven fabric in a direction to remove tension between warp and filling yarns in the twill, and maintaining the relatively tensionless relationship of the skewed fabric during the usual steps of finishing, cutting and sewing the fabric into garments whereby the relatively tensionless relationship between warp and fill remoins substantially constant throughout the life of the garment.

2. A method as in claim 1 wherein the fabric is a right-hand twill run face up and the direction of skew is counterclockwise.

3. A method as in claim 1 wherein the fabric is right-hand twill run face down and the direction of skew is clockwise.

4. A method as in claim 1 wherein the fabric is left-hand twill run face up and the direction of skew is clockwise.

5. A method as in claim 1 wherein the fabric is left-hand twill run face down and the direction of skew is counterclockwise.

6. A method as in claim 1 wherein the garment is laundered and tumble dried.

7. A method as in claim 1 wherein the skew is introduced by advancing the edge of the fabric in the direction of the twill relative to the opposite edge in an amount between four and ten percent of the width of the fabric.

8. A method as in claim 1 wherein the skew is approximately eight percent of the width of the fabric.

9. In a method of preventing leg twist in denim jeans made by weaving a twill fabric having tension between warp and filling yarn, cutting and sewing the twill fabric into jeans, the improvement comprising determining the direction of tension between warp and filling and introducing skew into the fabric by advancing the edge in the direction of the twill when run face up between four and ten percent of the width of the fabric to substantially reduce the tension existing in the fabric, whereby the relationship between warp and filling remains substantially constant throughout the life of the jeans.

* * * * *

UNITED STATES PATENT OFFICE

CERTIFICATE OF CORRECTION

Patent No. 3,959,826 Dated June 1, 1976

Inventor(s) Karin Hakanson

It is certified that error appears in the above-identified patent and that said Letters Patent are hereby corrected as shown below:

Figures 1 and 1A should appear as shown on the attached sheet.

Signed and Sealed this

Twenty-first Day of December 1976

[SEAL]

*Attest:*

RUTH C. MASON
*Attesting Officer*

C. MARSHALL DANN
*Commissioner of Patents and Trademarks*